US005888121A

United States Patent [19]

Kirchner et al.

[11] Patent Number: 5,888,121

[45] Date of Patent: Mar. 30, 1999

[54] CONTROLLING GROOVE DIMENSIONS FOR ENHANCED SLURRY FLOW

[75] Inventors: Eric J. Kirchner, Troutdale; Jayashree Kalpathy-Cramer, West Linn, both of Oreg.

[73] Assignee: LSI Logic Corporation, Milpitas, Calif.

[21] Appl. No.: 935,584

[22] Filed: Sep. 23, 1997

[51] Int. Cl.[6] ..... B24B 1/00

[52] U.S. Cl. ..... 451/41; 451/527; 451/534

[58] Field of Search ..... 451/921, 527, 451/530, 534, 537, 550, 56, 41

[56] References Cited

U.S. PATENT DOCUMENTS

| | | | |
|---|---|---|---|
| 5,081,051 | 1/1992 | Mattingly et al. | 437/10 |
| 5,177,908 | 1/1993 | Tuttle | 51/283 |
| 5,216,843 | 6/1993 | Breivogel | 51/131.1 |
| 5,297,364 | 3/1994 | Tuttle | 51/209 |
| 5,329,734 | 7/1994 | Yu | 51/283 |
| 5,489,233 | 2/1996 | Cook et al. . | |
| 5,628,862 | 5/1997 | Yu et al. | 156/345 |
| 5,645,469 | 7/1997 | Burke et al. | 451/41 |
| 5,690,540 | 11/1997 | Elliott et al. | 451/41 |
| 5,778,481 | 7/1998 | Amsden et al. | 15/230.16 |

*Primary Examiner*—David A. Scherbel
*Assistant Examiner*—Dung Van Nguyen
*Attorney, Agent, or Firm*—Beyer & Weaver, LLP

[57] ABSTRACT

A polishing pad surface designed for chemical mechanical polishing of substrates is described. The polishing pad includes a first area of the surface having formed thereon a first set of grooves and a second area of the surface having formed thereon a second set of grooves, wherein the first set of grooves have a larger cross-sectional area than the second set of grooves.

28 Claims, 6 Drawing Sheets

CONTROLLING GROOVE DIMENSIONS FOR ENHANCED SLURRY FLOW

BACKGROUND OF THE INVENTION

The present invention relates to polishing pads used for chemical-mechanical polishing of substrates. More particularly, the present invention relates to polishing pads having modified groove dimensions to produce a more uniformly polished substrate surface.

Chemical mechanical polishing (sometimes referred to as "CMP") typically involves mounting a substrate faced down on a holder and rotating the substrate face against a polishing pad mounted on a platen, which in turn is rotating or is in orbital state. A slurry containing a chemical component that chemically interacts with the facing substrate layer and an abrasive component that physically removes that layer is flowed between the substrate and the polishing pad or on the pad near the substrate. In semiconductor wafer fabrication, this technique is commonly applied to planarize various wafer layers such as dielectric layers, metallization layers, etc.

FIG. 1A shows a front view of a polishing pad 10, e.g., IC 1000 available from Rodel of Newark, Del., that is employed in modem CMP systems, such as the AvantGaard 676 available from Integrated Processing Equipment Corporation (IPEC) of Phoenix, Ariz. A surface of polishing pad 10 includes a plurality of macrogrooves 12, microgrooves 14 and slurry injection holes 16. Macrogrooves 12 are shown in an X-Y configuration, i.e. vertical and horizontal macrogrooves intersect at various points to form a "grid", microgrooves 14 are oriented substantially diagonally relative to macrogrooves 12 and slurry injection holes 16 are positioned at various intersections of the vertical and horizontal macrogrooves 12. FIG. 1C shows a cross-sectional view of a macrogroove 12 of FIG. 1A, which macrogroove is shaped like a square channel with sharp comers having a width (labeled "w") and a depth (labeled "d").

Those skilled in the art will recognize that microgrooves 14 are different from the grooves formed during conditioning of the polishing pad. Microgrooves 14 are formed by a polishing pad manufacturer during the fabrication of the polishing pad. Furthermore, microgrooves 14 of FIG. 1A are not limited to any particular configuration and may be obtained by a polishing pad manufacturer in other configurations. By way of example, FIG. 1B shows a surface of a polishing pad 20, which is also available from Rodel and typically employed in a conventional CMP system such as the Avanti 472 also available from Integrated Processing Equipment Corporation. Polishing pad 20 includes microgrooves 22 that are arranged in a spiral configuration and facilitate slurry flow.

The macrogroove dimensions of width and depth are typically larger than those of microgrooves. By way of example, macrogrooves 12 in the X-Y configuration shown in FIG. 1A typically have a width and depth of about 1 mm and microgrooves 14 typically have a width and depth that is about 250 $\mu$m. As another example, microgrooves 22 in the spiral configuration as shown in FIG. 1B typically have a width that is between about 100 $\mu$m and about 400 $\mu$m and a depth that is about 250 $\mu$m.

During a typical CMP process on the polishing pad surface of FIGS. 1A, slurry is introduced on the polishing pad surface via slurry injection holes that are in communication with a slurry reservoir. The "channel" shaped macrogooves facilitate slurry flow or distribution throughout the polishing pad surface. The rotating action of a substrate on the polishing pad picks-up some slurry from the macrogrooves and spills it on the microgrooves. As a result, a portion of slurry is dispersed between the polishing pad and substrate interface. A film on the substrate surface is removed by chemical and mechanical interaction with the slurry dispersed above microgroove.

After polishing on the same polishing pad over a period of time, however, the polishing pad suffers from "pad glazing." Pad glazing results when the particles eroded from the substrate surface along with the abrasives in the slurry tend to glaze or accumulate over the polishing pad. In order to remove this glaze, the polishing pad undergoes conditioning (hereinafter referred to as "pad conditioning") by a conditioning sub-assembly either every time after a substrate has been polished or simultaneously during substrate CMP.

A conditioning sub-assembly incorporated into the AvantGaard 676, for example, includes a conditioning arm having a conditioning surface with abrasive particles. During pad conditioning the conditioning arm forcibly sweeps back and forth across the polishing pad like a "windshield wiper blade" and a pneumatic cylinder applies a downward force on the conditioning arm such that the abrasive particles of the conditioning surface engage the polishing pad to remove the glaze and roughen up the polishing by introducing grooves or perforations on it.

Unfortunately, during the normal course of the polishing pad life, typically some areas of the polishing pad begin to erode (also known in the art as "pad erosion") or wear out due to the repeated abrasive action by the abrasive particles of the conditioning surface during conditioning and the repeated mechanical action of the substrate during CMP. In these worn out areas, the "channel" shape of the macrogrooves or microgrooves degrades sufficiently so that the macrogrooves are no longer effective in transporting slurry on the polishing pad surface. By way of example, in the AvantGaard 676, a center area of the polishing pad is relatively more worn out, e.g., the channel shape of the macrogrooves degrades to a greater extent in this area, than other areas of the polishing pad because the substrate contacts the center area of the polishing pad most of the time during CMP. As a result, there is nonuniform slurry flow on the polishing pad surface and the substrate surface suffers from a non-uniform film removal rate, which lowers the yield of the polished substrates.

What is therefore needed is an improved polishing pad design for effective slurry transport to produce a uniformly polished substrate surface.

SUMMARY OF THE INVENTION

To achieve the foregoing, the present invention provides a polishing pad surface designed for chemical mechanical polishing of substrates. The polishing pad includes a first area of the surface having formed thereon a first set of grooves and a second area of the surface having formed thereon a second set of grooves, wherein the first set of grooves have a larger cross-sectional area than the second set of grooves.

The first area may be located towards a center area of the surface and the second area may be located outside the center area. The first and second set of grooves may be macrogrooves and the second set of grooves may have a width and a depth of about 1 mm.

According to one embodiment of the present invention, the first and second set of grooves include a plurality of vertical and horizontal grooves intersecting at various points to form a grid. In this embodiment, a width of the first set of grooves may generally be between about 50% and about 100% larger than a width of the second set of grooves and preferably be about 75% larger than the width of the second set of grooves. Furthermore, a depth of the first set of grooves may generally be between about 50% and about 100% larger than a depth of the second set of grooves and preferably be about 75% larger than the depth of the second set of grooves.

In an alternative embodiment of the present invention, the first and second set of grooves may be arranged to form a spiral shaped groove on the surface and the spiral shaped groove in the first area may have a larger cross-sectional area than the spiral in the second area of the surface. In this embodiment, a depth and width of the first set of grooves may generally be between about 50% and about 100% larger than a depth of the second set of grooves and preferably 75% larger than a depth of the second set of grooves.

In the polishing pad of the present invention, slurry may be introduced on the surface by a plurality of slurry injection holes positioned on the polishing pad surface. In one embodiment, the first area of the present invention is located at a center area of a wafer track.

In another aspect, the present invention provides a process of providing a uniform film removal rate during chemical-mechanical polishing of a substrate. The process includes determining location of an underpolished region on the substrate, determining an area of a polishing pad surface that contacts the underpolished region of the substrate during chemical-mechanical polishing and modifying cross-sectional areas of a plurality of grooves formed on the area of the polishing pad surface that contacts the underpolished region of the substrate to increase the amount of slurry flowing to the area.

The location of the underpolished region on the substrate may be near a center region of the substrate. A center area of the polishing pad may contact the underpolished region of the substrate. The step of modifying the cross-sectional area of the groove, e.g., by enlarging the width or depth of the groove, may be facilitated by a router blade. The process of the present invention may further include a step of polishing the substrate or another substrate on the modified polishing pad surface.

In yet anther aspect, the present invention provides another process of providing a uniform film removal rate during chemical-mechanical polishing of a substrate. The process includes determining location of an area of a polishing pad surface that is worn out due to conditioning and modifying cross-sectional area of a plurality of grooves formed on the area of the polishing pad surface to increase the amount of slurry flowing to the area.

The worn out area of the polishing pad may be near a center area of the polishing pad surface. The step of modifying the cross-sectional area of the groove, e.g., by enlarging the width or depth of the groove, may be facilitated by a router blade.

The present invention represents a marked improvement over the conventional polishing pad design. By way of example, the modified polishing pad design of the present invention produces a more uniformly polished substrate surface, which translates into a higher yield for the polished substrates. As another example, the modified polishing pad design of the present invention prolongs the polishing pad life and therefore reduces the significant replacement cost of the polishing pads.

These and other features of the present invention will be described in more detail below in the detailed description of the invention and in conjunction with the following figures.

DETAILED DESCRIPTION OF THE PREFERRED EMBODIMENTS

The present invention provides polishing pads with modified groove dimensions to produce a more uniformly polished substrate surface. In the following description, numerous specific details are set forth in order to fully illustrate a preferred embodiment of the present invention. It will be apparent, however, that the present invention may be practiced without limitation to some specific details presented herein.

The present invention enhances slurry flow in slurry "starved" areas of a polishing pad by increasing a cross sectional area of grooves in those areas. By way of example, in the polishing pads used in the modem CMP systems, the cross-sectional area of the macrogrooves is enlarged and in the polishing pads used in the conventional CMP systems, the cross-sectional area of microgrooves is enlarged. Those skilled in the art will recognize that such macrogrooves and microgrooves are currently of substantially uniform cross-sectional area throughout the polishing pad surface.

The polishing pads of the present invention, however, have a surface that includes a first area having formed thereon a first set of macrogrooves and a second area having formed thereon a second set of macrogrooves such that the first set of macrogrooves has a larger cross-sectional area than the second set of macrogrooves. In an another embodiment, the polishing pads of the present invention include a first area having formed thereon a first set of microgrooves and a second area having formed thereon a second set of microgrooves such that the first set of microgrooves has a larger cross-sectional area than the second set of microgrooves.

Figure 1A:
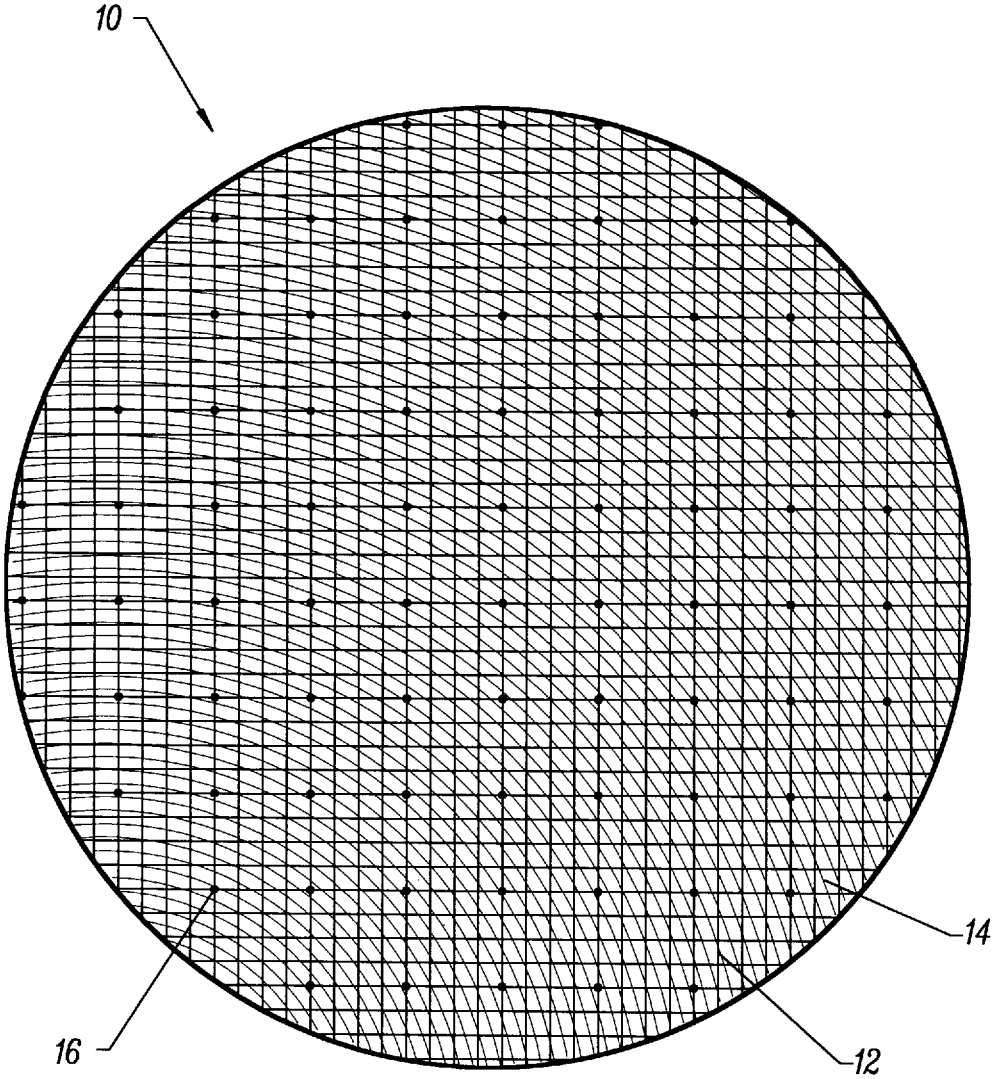
FIG. 1A shows a front view of a polishing pad having macrogrooves in an X-Y configuration.
Figure 2:
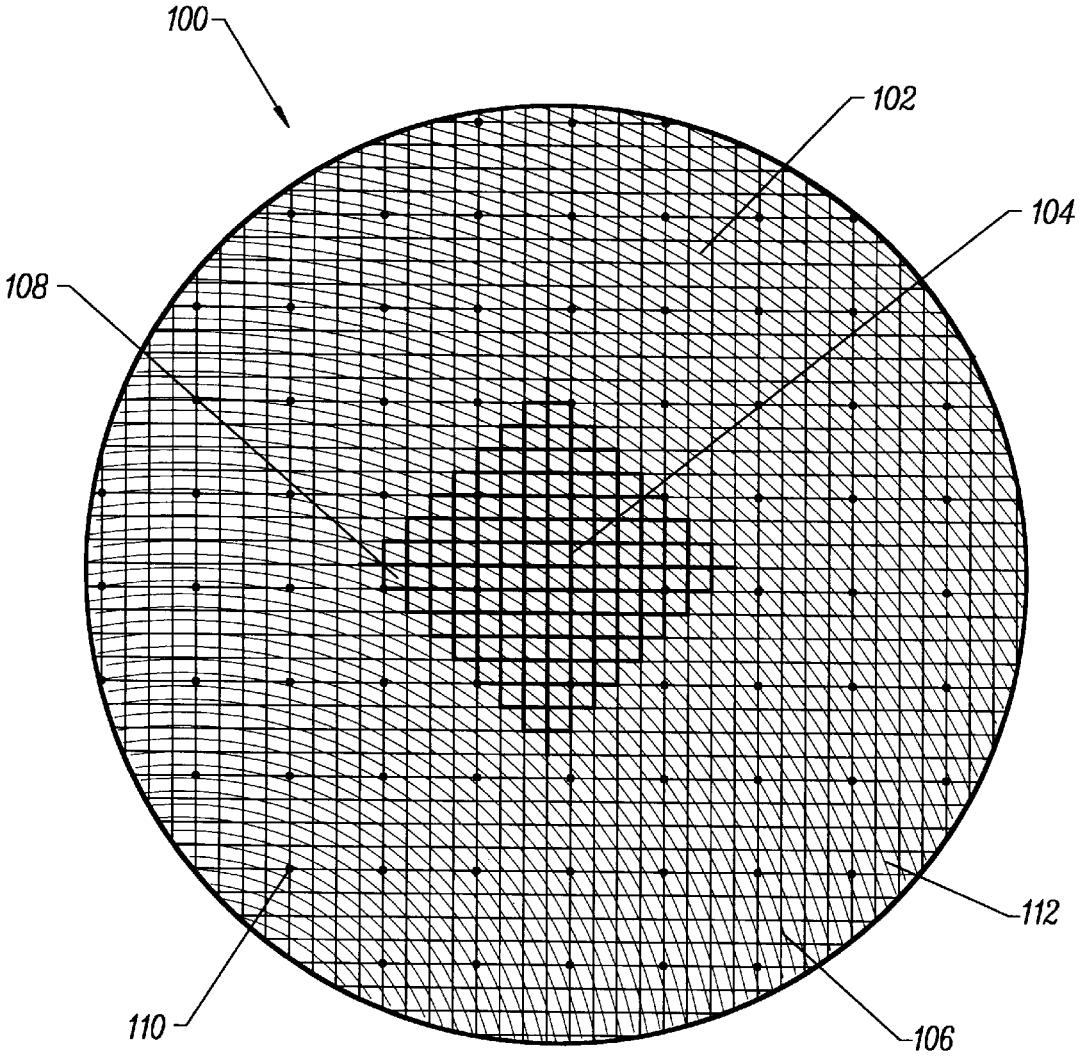
FIG. 2 shows a front view of a modified polishing pad, according to one embodiment of the present invention, which may be employed in the modern CMP systems.

FIG. 2 shows a front view of a polishing pad 100, according to one embodiment of the present invention, including macrogrooves having a nonuniform cross-sectional area. Polishing pad 100 may be employed in the AvantGaard 676 mentioned above, for example. In this embodiment, the first area is a center area 104, which has a first set of macrogrooves 108, and the second area is an area outside center area 104 that is shown by a reference number 102, which has a second set of macrogrooves 106. As shown in FIG. 2, macrogrooves 108 are wider than macrogrooves 106 and therefore have a larger cross-sectional area than macrogrooves 106. Slurry injection holes 110 of polishing pad 100 are positioned at the intersections of macrogrooves 106 and of macrogrooves 108 to facilitate slurry flow on the polishing pad. Microgrooves 112 may be substantially similar to the conventional microgrooves shown in FIG. 1A and have a substantially uniform cross-sectional area in both center area 104 and area 102.

Substrates of the present invention include semiconductor substrates and other integrated circuit substrates, magnetic media substrates, optical substrates, etc. Polishing pad 100 may include at least one of urethane, polyurethane, polymer, felt and a filler material. If polishing pad 100 is employed in AvantGaard 676, then the diameter of the polishing pad is about 10.5 inches. Center area 104 is not limited to the substantially square shape shown in FIG. 2, but may be substantially circular, rectangular or of other suitable geometrical shapes. Microgrooves 112 and slurry injection holes 110 may have conventional dimensions well known to those skilled in the art.

The width and depth of macrogrooves 106 may have conventional dimensions mentioned above and macrogrooves 108, as mentioned above, have a larger cross-sectional area than macrogrooves 106. An increase in the cross-sectional area of macrogroove 108 can be realized in many ways. By way of example, macrogroove 108 may have the same depth as a conventional macrogroove, e.g., macrogroove 106, however, macrogroove 108 may be wider than macrogroove 106, as shown in FIG. 2. As a further example, macrogroove 108 may have the same width as macrogroove 106, however, macrogroove 108 may be deeper than macrogroove 106. Further still, both the width and depth of macrogroove 108 may be larger than those of macrogroove 106. By way of example, macrogroove 108 has a width and depth that is between about 50% and about 100% larger than those of macrogroove 106 and preferably about 75% larger than those of macrogroove 106.

A typical CMP process on polishing pad 100 of FIG. 2 is carried out substantially similarly as discussed above with reference to FIG. 1A. It is important to note, however, that slurry flow is enhanced at center area 104 of polishing pad, according to the present invention, relative to area 102 because macrogrooves 108 of center area 104 have a larger cross-sectional area than macrogrooves 106 of area 102. Thus, by increasing the cross-sectional area of the macrogrooves in an area of the polishing pad that produces an underpolished area, the present invention enhances slurry flow to such areas of the polishing pad and thereby promotes uniform film removal rate.

Figure 1B:
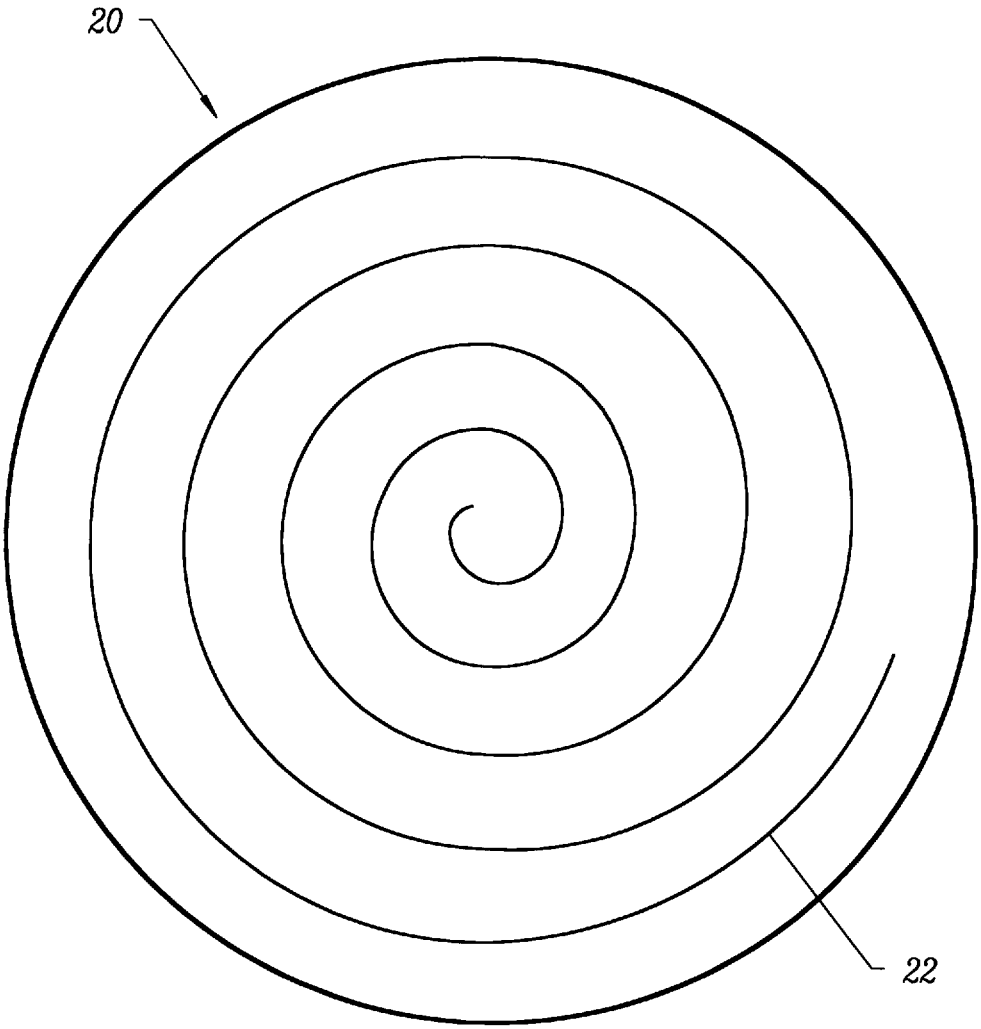
FIG. 1B shows a front view of a polishing pad having microgrooves in a spiral configuration.
Figure 1C:
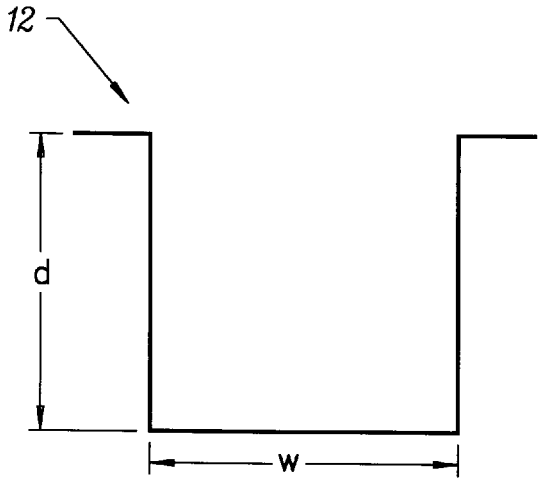
FIG. 1C shows a cross-sectional view of a macrogroove of FIG. 1A that is shaped like a channel.
Figure 3:
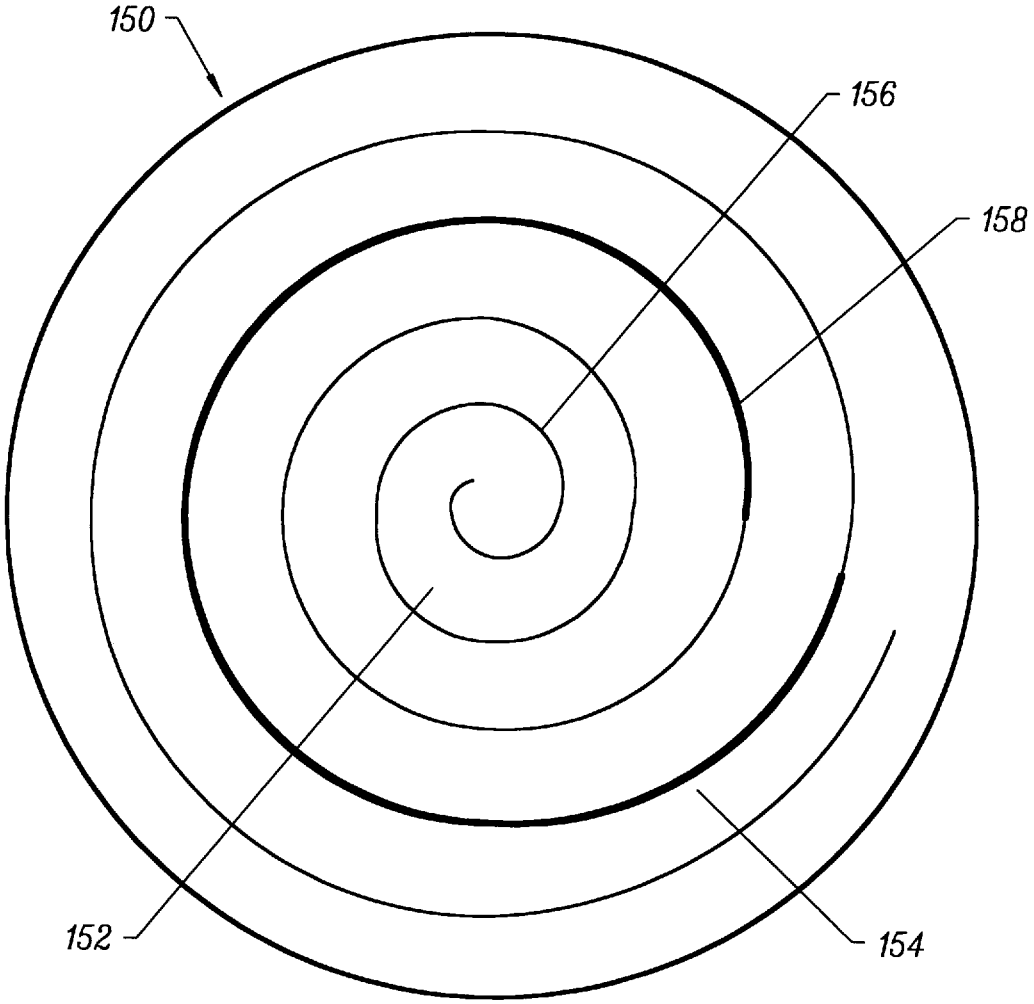
FIG. 3 shows a front view of a modified polishing pad, according to another embodiment of the present invention, which may be employed in the conventional CMP systems.

FIG. 3 shows a modified polishing pad design of FIG. 1B that may be implemented for polishing pads used in conventional CMP systems, e.g., Avanti 472 mentioned above. Polishing pad 150 includes a first area 154 having formed thereon a microgroove 158 that is relatively wider than microgroove 156 of a second area 152. It is important to note that first area 154 having relatively wider microgrooves may be located at a center region of a wafer track, which is the area of the polishing pad that generally contacts the substrate during CMP in conventional CMP systems. Those skilled in the art will recognize that the cross-sectional area of microgroove 158 can be enlarged by increasing the depth of the microgroove in first area 154. By way of example, microgroove 158 has a width and depth that is between about 50% and about 100% larger than those of microgroove 156, preferably 75% larger than those of microgroove 156. Polishing pads employed in the Avanti 472 have a diameter that is generally about 22.5 inches.

Figure 4:
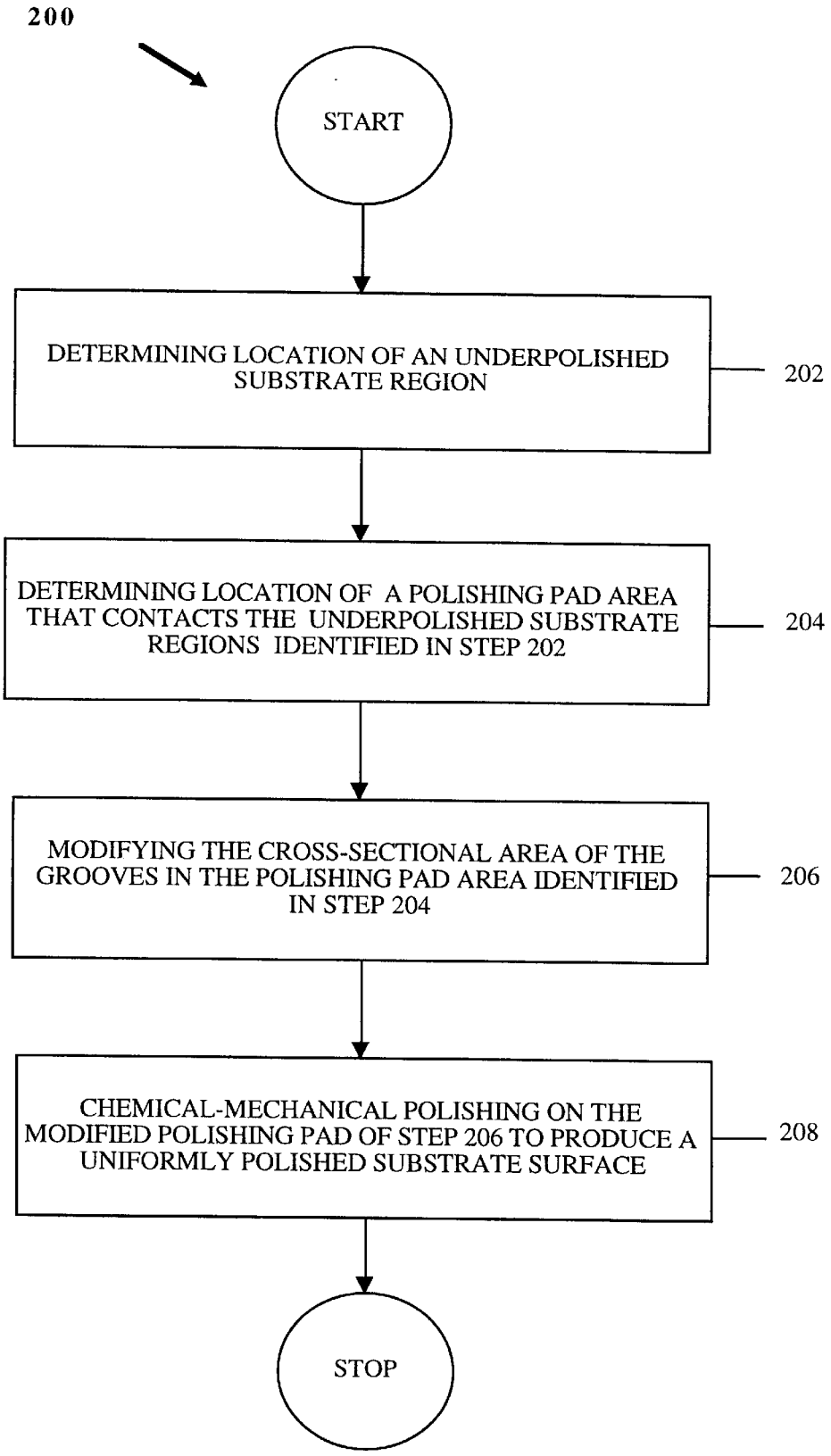
FIG. 4 shows a process of producing a more uniformly polished substrate surface, according to one embodiment of the present invention.

FIG. 4 shows a process 200, according to one embodiment of the present invention, for producing a uniformly polished substrate surface. Process 200 is preferably implemented to combat the non-uniformly polished substrate surface produced due to "center slow" polishing, which is described in detail hereinafter. After polishing a significant number of substrates on the same polishing pad, an area of the polishing pad that contacts a center region of the substrate often deteriorates to a greater extent than other areas of the polishing pad. This deterioration is attributed primarily to more vigorous conditioning at the center region. In the polishing pads employed in the AvantGaard 676, for example, an area near the center area of the polishing pad typically requires and receives more vigorous conditioning and therefore deteriorates to a greater extent, e.g., the channel shape of the macrogroove significantly degrades. As a further example in the Avanti 472, a center region of a wafer track on the polishing pad deteriorates to a greater extent for similar reasons.

As a result, well before the end of a production lot draws near, the substrate subjected to CMP experience a slower film removal rate at the center region of the substrate relative to the edge or peripheral regions of the substrate surface, which phenomenon is known in the art as "center slow polishing." "Production lot" refers to a collection of substrate that are fabricated as a group under substantially similar conditions and may ultimately be sold. Center slow polishing is undesirable because it leads to a non-uniformly polished substrate surface, i.e. the center region of the susbtrate surface is not polished to the same extent as the peripheral region of the wafer. Furthermore, a polishing pad producing non-uniformly polished substrate surfaces lowers the yield of polished substrates and is therefore discarded. In a typical substrate fabrication facility, where several CMP apparatus are employed, the replacement cost of polishing pads can be significant.

Process 200 begins at a step 202, in which the location of underpolished substrate region is determined. As mentioned above, the center region of the substrate surface is typically underpolished when a substrate experiences center slow polishing. In other cases, step 202 is carried out by examining the polished substrate surface under visual inspection systems, such as microscopes, scanning electron microscopes (SEMs) and automatic machines well known to those skilled in the art. Of course, in this step, more than one as opposed to a single underpolished regions on the substrate surface may be identified and polishing pad areas that produce such underpolished substrate regions may be modified (as described below) collectively in a single step.

Next, in a step 204 a location of the polishing pad that produced the underpolished substrate region of step 202 is determined. In the polishing pad employed in AvantGaard 676, for example, an area near the center area of the polishing pad produces the underpolished center region of the substrate. As mentioned before, in Avanti 472, an area at the center area of a wafer track produces the underpolished center region of the substrate.

In a step 206, the cross-sectional area of grooves in the polishing pad area determined in step 204 is then modified, e.g., by enlarging either the width or depth of the macrogroove or both. In this step, the cross-sectional area of a conventional macrogroove or microgroove located in the polishing pad area determined in step 204, may be enlarged by sciving a portion of the polishing pad using a router blade, for example, to form a macrogroove or microgroove that is wider, deeper or both relative to macrogrooves or microgroove in other areas. By way of example, in the polishing pad employed in the AvantGaard 676, the cross-sectional areas of the macrogrooves in the center area of the polishing pad are increased, as shown in FIG. 2, to form a polishing pad of the present invention. As a further example, the cross-sectional areas of the microgrooves at the center area of a wafer track on the polishing pad are increased, as shown in FIG. 3.

Finally, in step 208, either the substrate surface with the underpolished region or another substrate is subjected to CMP on the modified polishing pad of step 206 to produce a more uniformly polished substrate surface. It is important to note that the polishing pad modified according to the present invention provides more slurry to the substrate region that is underpolished or would be underpolished after CMP had concluded and therefore such regions experience a higher film removal rate to produce a more uniformly polished substrate surface.

According to an alternative embodiment, steps 202 and 204 are by-passed and groove enlargement of step 206 is carried out on those areas of the polishing pad that undergo more vigorous conditioning. By way of example, when center slow polishing conditions are exhibited by the polishing pads of AvantGaard 676, the center area of the polishing pad, which undergoes relatively more vigorous conditioning than other areas of the polishing pad, is modified according to the present invention. As a further example, when center slow polishing conditions are exhibited by the polishing pads of Avanti 472, a center region of a wafer track is modified according to the present invention.

The present invention represents a marked improvement over the conventional polishing pad design. By way of example, as mentioned above the modified polishing pad design of the present invention produces a more uniformly polished substrate surface, which translates into a higher yield for the polished substrates. As another example, the modified polishing pad design of the present invention prolongs the polishing pad life and therefore reduces the significant replacement cost of the polishing pads.

Although the foregoing invention has been described in some detail for purposes of clarity of understanding, it will be apparent that certain changes and modifications may be practiced within the scope of the appended claims. For example, while the specification has described modifying the polishing pad surface in the context of chemical-mechanical polishing, there is no reason why in principle polishing pads used in other polishing applications cannot be modified similarly. Therefore, the present embodiments are to be considered as illustrative and not restrictive, and the invention is not to be limited to the details given herein, but may be modified within the scope of the appended claims.

What is claimed is:

1. A polishing pad surface designed for chemical mechanical polishing of substrates, comprising:

a first area of said surface having formed thereon a first set of grooves; and a second area of said surface having formed thereon a second set of grooves, wherein said first set of grooves have a larger cross-sectional area than said second set of grooves and said first area does not overlap said second area.

2. The polishing pad surface of claim 1, wherein said first area is located towards a center area of said surface and said second area is located outside said center area.

3. The polishing pad surface of claim 1, wherein said first and second set of grooves are macrogrooves and said second set of grooves have a width and a depth of about 1 mm.

4. The polishing pad surface of claim 1, wherein said first and second set of grooves include a plurality of vertical and horizontal grooves intersecting at various points to form a grid.

5. The polishing pad surface of claim 4, wherein a width of said first set of grooves is between about 50% and about 100% larger than a width of said second set of grooves.

6. The polishing pad surface of claim 5, wherein said width of said first set of grooves is about 75% larger than said width of said second set of grooves.

7. The polishing pad surface of claim 4, wherein a depth of said first set of grooves is between about 50% and about 100% larger than a depth of said second set of grooves.

8. The polishing pad surface of claim 7, wherein said depth of said first set of grooves is about 75% larger than said depth of said second set of grooves.

9. The polishing pad surface of claim 1, wherein said first and second set of grooves are arranged to form a spiral shaped groove on said surface and said spiral shaped groove in said first area has a larger cross-sectional area than said spiral shaped groove in said second area of said surface.

10. The polishing pad surface of claim 9, wherein a depth of said spiral shaped groove in said first area is between about 50% and about 100% larger than a depth of said spiral shaped groove in said second area.

11. The polishing pad surface of claim 9, wherein a width of said spiral shaped groove in said first area is between about 50% and about 100% larger than a width of said spiral shaped groove in said second area.

12. The polishing pad surface of claim 9, wherein said first area is located at a center area of a wafer track.

13. The polishing pad surface of claim 1, wherein slurry is introduced on said surface by a plurality of slurry injection holes positioned on said surface.

14. A process of providing a uniform film removal rate during chemical-mechanical polishing of a substrate, comprising:

determining location of an underpolished region on said substrate;

determining an area of a polishing pad surface that contacts said underpolished region of said substrate during chemical-mechanical polishing; and modifying cross-sectional areas of a plurality of grooves formed on said area of said polishing pad surface that contacts said underpolished region of said substrate to increase the amount of slurry flowing to said area.

15. The process of claim 14, where in said location of said underpolished region on said substrate is near a center region of said substrate.

16. The process of cl aim 14, wherein a center area of said polishing pad contacts said underpolished region of said substrate.

17. The process of claim 14, wherein said modifying is facilitated by a router blade.

18. The process of claim 14, wherein said modifying includes increasing a width of grooves of said area.

19. The process of claim 14, wherein said modifying includes increasing a depth of grooves of said area.

20. The process of claim 14, further comprising a step of polishing said substrate or another substrate on said modified polishing pad surface.

21. A process of providing a uniform film removal rate during chemical-mechanical polishing of a substrate, comprising:

determining location of an area of a polishing pad surface that is worn out due to conditioning; and modifying cross-sectional area of a plurality of grooves formed on said area of said polishing pad surface to increase the amount of slurry flowing to said area.

22. The process of claim 21, wherein said area is near a center area of said polishing pad surface.

23. The process of claim 21, wherein said modifying is facilitated by a router blade.

24. The process of claim 21, wherein said modifying includes increasing a width of grooves of said area.

25. The process of claim 21, wherein said modifying includes increasing a depth of grooves of said area.

26. A process of producing a substantially uniformly polished substrate surface, comprising:

providing a polishing pad including a first area on a polishing pad surface having formed thereon a first set of grooves; and a second area on said polishing pad surface having formed thereon a second set of grooves, wherein said first set of grooves have a larger cross-sectional area than said second set of grooves and said first area does not overlap said second area; and polishing said substrate surface on said polishing pad to provide enhanced slurry flow in first set of grooves and thereby provide a substantially uniformly polished substrate surface.

27. The polishing pad surface of claim 26, wherein said first area is located towards a center area of said surface and said second area is located outside said center area.

28. The polishing pad surface of claim 26, wherein said first and second set of grooves are macrogrooves and said second set of grooves have a width and a depth of about 1 mm.

* * * * *